US006669192B2

(12) United States Patent
Reist

(10) Patent No.: US 6,669,192 B2
(45) Date of Patent: Dec. 30, 2003

(54) METHOD AND DEVICE FOR TRANSFORMING A CONVEYING STREAM OF FLAT ARTICLES

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/197,084

(22) Filed: Jul. 17, 2002

(65) Prior Publication Data

US 2003/0015837 A1 Jan. 23, 2003

(30) Foreign Application Priority Data

Jul. 18, 2001 (CH) ..... 1335/01

(51) Int. Cl.[7] ..... B65H 33/16

(52) U.S. Cl. ..... 271/225; 271/184; 271/69; 271/204; 271/82; 271/300; 198/374

(58) Field of Search ..... 271/225, 184, 271/204, 205, 82, 300, 69, 301, 306, 279, 280; 198/374, 419.2, 418.7, 418.8

(56) References Cited

U.S. PATENT DOCUMENTS

| | | | | |
|---|---|---|---|---|
| 4,214,743 A | | 7/1980 | Meier | |
| 4,316,565 A | * | 2/1982 | Hodgkinson et al. | 225/99 |
| 4,684,117 A | | 8/1987 | Honegger et al. | |
| 5,209,810 A | * | 5/1993 | Marschke | 156/563 |
| 5,810,346 A | * | 9/1998 | Jorg | 270/59 |
| 5,873,451 A | * | 2/1999 | Backman | 198/418.6 |
| 6,062,372 A | * | 5/2000 | Cote et al. | 198/440 |
| 6,139,252 A | * | 10/2000 | Honegger | 414/791.2 |
| 6,401,903 B1 | * | 6/2002 | Berni | 198/370.01 |
| 6,406,014 B1 | * | 6/2002 | Reist | 271/3.24 |
| 6,581,752 B2 | * | 6/2003 | Frei | 198/440 |
| 6,588,745 B2 | * | 7/2003 | Gosslinghof | 271/225 |

FOREIGN PATENT DOCUMENTS

| | | |
|---|---|---|
| DE | 195 30 499 A1 | 2/1997 |
| EP | 0 854 105 A1 | 7/1998 |
| EP | 1 057 762 A1 | 12/2000 |
| FR | 2 422 575 A | 11/1979 |

OTHER PUBLICATIONS

WO 99/33731, Conveyor System, Publication Date: Jul. 8, 1999 (Discussed on p. 10 of specification).

* cited by examiner

*Primary Examiner*—Patrick Mackey
(74) *Attorney, Agent, or Firm*—Rankin, Hill, Porter & Clark LLP

(57) ABSTRACT

A conveying-in stream in which flat articles (4) are conveyed held gripped individually is transformed into a conveying-away stream in which the articles (4) are loosely lying overlapping one another in an imbricated manner and in alternating groups oriented rotated relative to each other. The conveying-in track intersects with the conveying away track at two track intersections (A and B) and the articles (4) are transferred from the conveying-in track to the conveying-away track in alternating groups (1A, 1B, 2A, 2B . . . ) at the first track intersection (A) or at the second track intersection (B). In the conveying-away stream, the articles (4) are arranged in imbricated stream sections (1A/1B) with each section including one or two groups (1A, 1B, 2A, 2B . . . ) of articles (4) and being separated from neighboring sections by a stream gap (22). The stream transformation is particularly suitable for subsequent stacking of the articles (4) wherein, without any further measures, the articles are stacked in cross stacks and the stream gaps (22) can be used for removing finished stacks.

18 Claims, 6 Drawing Sheets

METHOD AND DEVICE FOR TRANSFORMING A CONVEYING STREAM OF FLAT ARTICLES

BACKGROUND OF THE INVENTION

1. Field of the Invention

The present invention is related to the field of conveying technology and concerns a method and a device for transforming a conveying stream of flat articles, such as for establishing from a conveying stream, in which all articles have the same orientation, a conveying stream with alternating article groups, in which the articles are differently oriented.

2. Description of the Related Art

For conveying flat articles, such as printed products (e.g., newspapers, periodicals, etc.), in many cases grippers are used. The grippers move one behind the other and each one holds an article in an edge zone. Usually, all held articles are oriented in substantially the same way. In such a conveying stream periodicals are, for example, held gripped from above in the zone of their spine edge and are conveyed such that all front sides are facing downstream.

Printed products, such as the named periodicals, are, for example, conveyed to a stacking shaft in which they are deposited in a stack. If this stack is to be a cross stack, which is a stack in which the articles form alternating groups rotated by 180° relative to one another (spine edges of the periodicals positioned partially on one and partially on the other side of the stack), the stacking shaft and the stack being produced are rotated after the depositing of each group of printed products. This is described in the publication DE-2842117 (or U.S. Pat. No. 4,214,743). For the same purpose, it is also known, as described in the publication DE-19530499 (Gorny), to split the conveying stream into two partial streams prior to deposition of the printed products in the stacking shaft and to convey the two partial streams to the stacking shaft in a different manner or direction. In this way, the printed products conveyed in one part stream are rotated by 180° relative to the printed products conveyed in the other part stream. It is further known, to rotate printed products groupwise in the conveying stream and to stack the so-transformed stream in this manner to create cross stacks without the need of further measures. A device for transforming a conveying stream in this manner is described, for example, in the publication EP-0854105. The described transformation concerns a conveying stream, in which the products are conveyed held gripped individually, and the transformation is implemented by temporarily taking over the products by grippers of an auxiliary system.

The devices for implementing the known methods using stack rotation are relatively simple, providing that stopping the article supply for every stack rotation is acceptable. If, however, the performance capacity has to be high or the cycle time has to be as short as possible, either a switch point has to be provided for splitting the supply stream such that the products can be supplied to two stacking shafts or else the articles supplied during stack rotation have to be intermediately stacked. Both measures render the devices significantly more elaborate. The methods mentioned above using stream splitting for different ways of supply of the part streams, as well as the methods using stream transformation, can be implemented with more simple stacking devices and higher performance capacities. However, for splitting or transforming the stream more elaborate devices and control systems are needed.

SUMMARY OF THE INVENTION

The present invention is directed toward a method and device for transforming a conveying-in stream, in which flat articles are conveyed held gripped individually, into a conveying-out stream, in which the articles form groups that are orientated differently. The method according to the invention is to be significantly simpler than known conveying stream transformations serving similar purposes. Nonetheless, the stream transformation is to be capable of being implemented for article groups of varying sizes. The method in accordance with the invention is to be able to be implemented using a very simple device and a simple control system.

In most cases the method according to the invention will produce from a conveying-in stream, in which the flat articles are oriented in substantially the same way, a conveying-away stream, in which the articles of successive groups are alternately differently oriented such that, when they are conveyed to a stacking shaft, the successive groups of articles are stacked in a cross stack without further measures needed. Obviously, the method in accordance with the invention can also used for transforming a conveying-in stream, in which the articles have differing orientations, into a conveying-away stream, in which the articles have all the same orientation or have again differing orientations.

In accordance with the inventive method, the conveying-in track, along which the articles are conveyed individually held, intersects twice with a conveying-away track, along which the articles are conveyed away in a transformed stream, and of handing over conveyed-in groups of articles from the conveying-in track to the conveying-away track alternately at the first and at the second track intersection. The handing-over is preferably a simple depositing of the articles conveyed, each held by a gripper, along the conveying-in track, onto a conveying substrate, such as a conveyor belt, moving along the conveying-away track.

The angle of intersection between the conveying-in track and the conveying-away track for both track intersections is, for example, 90°, but may also be greater or smaller than 90°. In both handing-overs, the printed products are reoriented in dependence upon the intersection angle, for example, by 90° (e.g., transformation of transverse conveying to longitudinal conveying for rectangular, flat articles). Because the conveying-in track meets the conveying-away track from opposite sides in the two track intersections, there is, in addition to the above mentioned re-orientation, a rotation by 180° for articles handed over at the one intersection relative to articles handed over at the other intersection. Therefore, in a stream transformed with the method according to the invention, articles of every second group are rotated by 180° relative to articles of the respectively first groups.

Advantageously, the articles are conveyed in the conveying-in stream transverse to their plane extent. The articles are, for example, held gripped at a top edge and are substantially freely suspended, wherein the distances between the products are smaller than their plane extent. Advantageously also, the articles conveyed-in in this manner are deposited onto the conveying substrate of the conveying-away track overlapping one another, so that the transformed conveying-away stream is an imbricated stream comprising gaps at least after every second group of articles.

In accordance with the inventive device, a conveying-in means defines a conveying-in track and has grippers arranged one behind the other and movable along the conveying-in track in a conveying-in direction. The device further comprises a conveying-away means defining a conveying-away track, which at least in a transformation zone comprises a conveying substrate extending along the conveying-away track and moving in a conveying-away direction. In the transformation zone, the conveying-in track and conveying-away track intersect twice. Furthermore, the device comprises control means in the transformation zone for selectively opening the grippers for a groupwise handing-over of articles at the first and at the second track intersection.

In further accordance with the present invention, the grippers of the conveying-in means are independent of one another such that the distances between these grippers are variable and the grippers can be stopped and buffered immediately upstream of the track intersections.

BRIEF DESCRIPTION OF THE DRAWINGS

These and further features of the method and the device according to the invention will be apparent with reference to the following description and drawings, wherein:

(FIG. 4: one conveying-in track, one conveying-away track, two track intersections; FIG. 5: one conveying-in track, two conveying-away tracks, four track intersections); and, FIG. 7 shows an exemplary application of the device according to the invention as shown in FIG. 1.

DETAILED DESCRIPTION OF THE PREFERRED EMBODIMENTS

Figure 1:
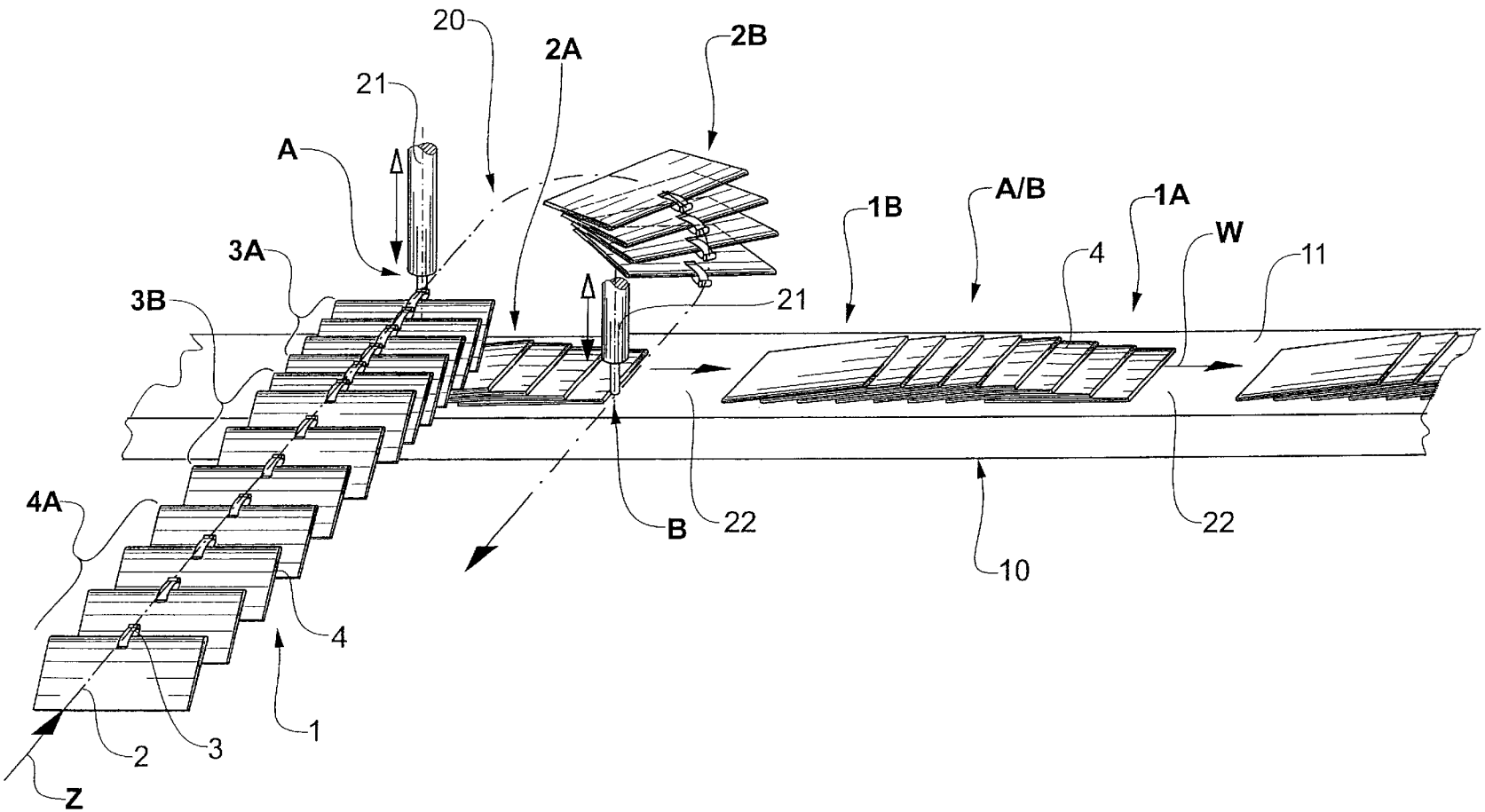
FIG. 1 is a schematic, three-dimensional depiction of an exemplary embodiment of the device according to the invention, showing a conveying-in means, a conveying-away means and two track intersections (intersection angle of 90°) and gripper buffering upstream of the two track intersections.

FIG. 1 shows an exemplary embodiment of the device according to the invention very schematically and three-dimensionally. It serves for explaining the method in accordance with the invention.

The device comprises as a conveying-in means 1 a rail 2 (depicted as a dot-dash line), along which grippers 3 are displaceable in a conveying-in direction Z. The grippers are independent of one another, and can have variable spacings between each other. The flat articles 4 (for example, rectangular printed products) are held gripped with the help of the grippers 3 at an upper edge zone (for example, longer folded edges of rectangular, folded printed products) and are conveyed suspended or hanging downwards. The device further comprises a conveying-away means 10 with a conveying substrate 11, which preferably and advantageously moves with a constant speed in the conveying-away direction W.

The conveying-away track defined by the conveying-away means 10 runs in a straight line and substantially horizontally through a transformation zone 20 and, in this transformation zone 20, is intersected twice by the conveying-in track defined by the conveying-in means 1 (track intersections A and B). The conveying-in track comprises a deflection by 180° between the two track intersections and at least within the transformation zone 20 runs above the conveying substrate 11 of the conveying-away means 10 such that the conveyed-in articles 4 held by the grippers 3 can be deposited on the conveying substrate 11 of the conveying-away means 10 by simply opening the grippers 3.

At each one of the two track intersections A and B, the device comprises a control means 21 for selectively opening grippers 3 being conveyed across the track intersection such that an affected article is deposited from the opened gripper onto the conveying substrate 11 of the conveying-away means 10 in an as controlled manner as possible, or else is conveyed over it by a gripper which is not opened.

The device further comprises damming means, whose function may, for example, be taken over by the control means 21. The damming means are designed to selectively stop grippers 3 conveyed towards the track intersections A, and B on the rail 2, immediately upstream of the track intersections A and B or upstream of the point, at which the grippers 3 are opened respectively. Following grippers are banked up behind a stopped gripper.

In alternating groups, the conveyed-in articles 4 are either deposited at the track intersection A or else pass the track intersection A and are deposited on the track intersection B. The depositing cadence is thereby matched to the conveying-in capacity so that the depositing capacity averaged over the time is equal to the conveying-in capacity. The conveying-away speed may be determined by a further processing operation and is advantageously selected so that the articles 4 deposited as groups are deposited onto the conveying substrate 11 overlapping one another.

Article groups deposited or to be deposited one after the other at the track intersection A are designated in FIG. 1 with 1A, 2A, etc., article groups deposited or to be deposited one after the other at the track intersection B are designated with 1B, 2B, etc., wherein the groups 1A, 1B and 2A have already been deposited, the group 2B has already passed the track intersection A, but has not yet been deposited and the groups 3A, 3B and 4A are still on the conveying-in track upstream of the track intersection A.

For carrying out the method in accordance with the invention, groups of, for example, four articles 4 each, are deposited onto the conveying substrate 11 at the track intersection A (A-groups) and alternately with these A-groups, groups of, for example, four articles, are conveyed across the track intersection A and are deposited at the track intersection B (B-groups). Obviously, the articles of the B-groups are rotated by 180° relative to the articles of the A-groups on the conveying substrate 11 of the conveying away-means 10. If the conveyed-in articles are rectangular, folded printed products being conveyed held gripped at the one longer edge, which is the folded edge, then the printed products are conveyed away in longitudinal direction, wherein in the A-groups the folded edges are facing away from the viewer of FIG. 1 and in the B-groups they are facing the viewer.

The damming means of the track intersection A is controlled such that the grippers 3 with articles to be conveyed there-past (i.e., the B-groups) pass without obstruction, the grippers during deposition of articles of an A-group are conveyed onwards without obstruction, and the grippers with articles of a following A-group are dammed for long enough for gaps to form between A-groups deposited at the track intersection A on the conveying substrate of the conveying away means. These gaps need to be sufficiently large for receiving a B-group at the track intersection B.

The damming means of the track intersection B is controlled in so that the grippers 3, which have already deposited articles of A-groups, pass unobstructed, the grippers with articles of B-groups to be deposited are conveyed onwards unobstructed, and the grippers with articles of a following B-group are dammed for long enough for each next B-group to be placed into the next gap between two A-groups.

It is not possible to deposit a continuous imbricated stream onto the conveying substrate 11, if no additional measures are provided for pushing articles 4 deposited at the track intersection B under the following, but already deposited, articles of the subsequent A-group. The smallest possible deposition gaps to be provided between A-groups, are longer by the expanse of an article 4 in the conveying-away direction than the effective space requirement of the group in a gapless imbricated stream. In such a deposition gap the last article 4 of a B-group can be deposited in front of the first article of the following A-group. B-groups can be deposited on preceding A-groups with a gap (larger than the normal article spacing in the imbricated stream) or without a gap (as illustrated in FIG. 1). In the latter case, regular imbricated stream sections A/B are produced on the conveying substrate 11 of the conveying-away means 10, each of the sections containing an A-group and a B-group of articles 4, and being separated from one another by stream gaps 22. The stream gaps 22 are at least large enough for the trailing edge of the article downstream of the gap to be positioned downstream of the leading edge of the following article (no overlap). These gaps without overlap can be matched with respect to their size to circumstances further downstream. Such gaps can also be closed subsequently using known means.

For the exemplary embodiment of the device according to the invention as illustrated in FIG. 1, it is not essential how long the conveying-in track and the conveying-away track are between the track intersections A and B. Furthermore, it is not a condition that the A-groups comprise the same number of articles as the B-groups. It is also not a condition either that the track intersection B is arranged downstream of the track intersection A in the conveying-away direction. Rather, the track intersection B could equally well be situated upstream of the track intersection A relative to the conveying-away direction, wherein the imbricated stream sections then produced would each respectively consist of a B-group and of an A-group following the B-group.

Realisation of a device as illustrated in FIG. 1 does not represent any problem for one skilled in the art and knowing the invention. A conveying system suitable as conveying-in means is described, for example, in the publication WO-99/33731.

Figure 2:
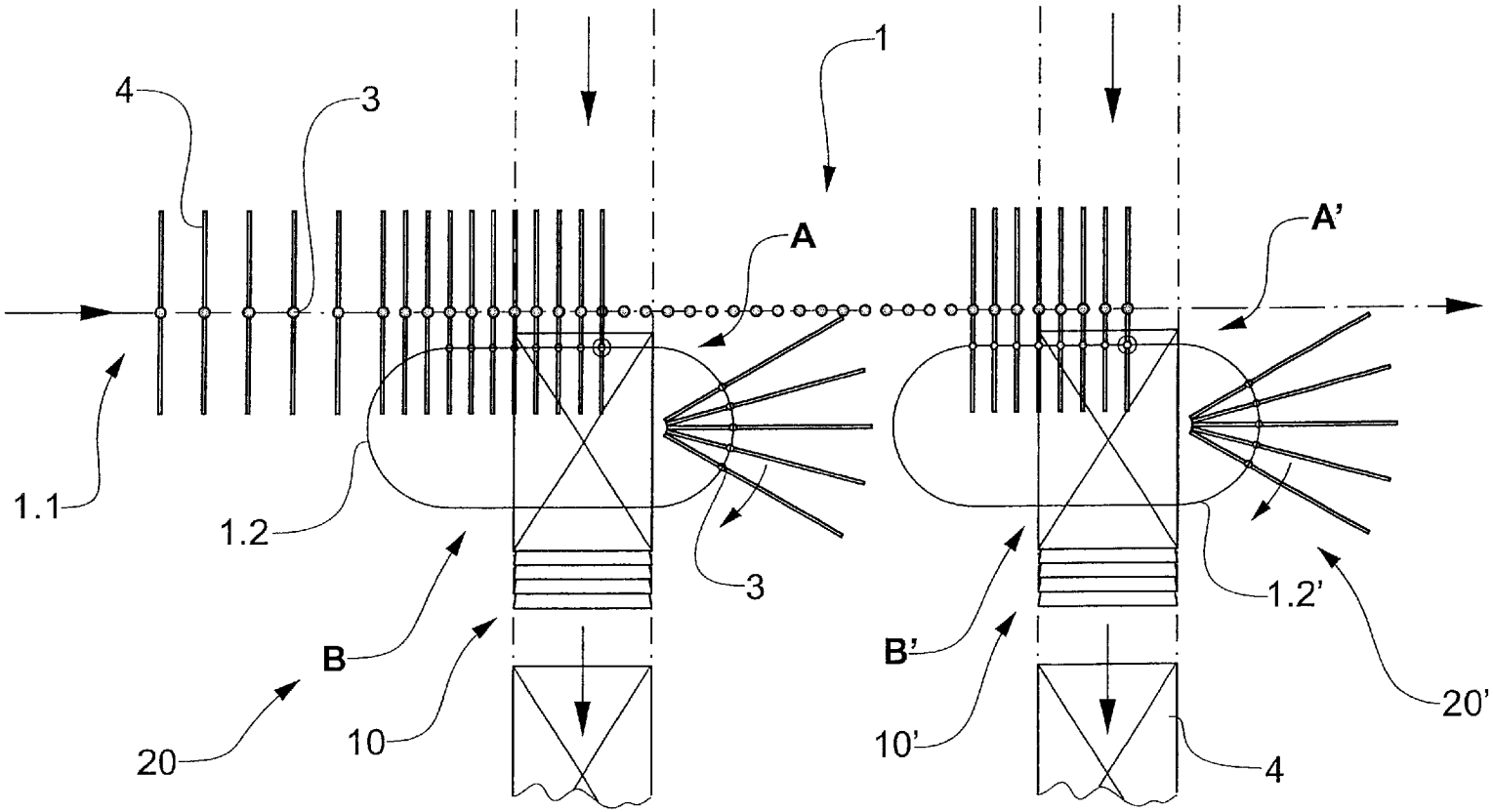
FIG. 2 is a schematic diagram of a stream transformation in accordance with the method according to the invention showing a conveying-in track and two conveying-away tracks (four track intersections with intersection angles of 90°)

FIG. 2 shows from a bird's eye view and once again very schematically, a further, exemplary embodiment of the method in accordance with the invention. The same parts of the respective device are designated with the same reference numbers as in FIG. 1. There are two conveying-away means 10 and 10'. The conveying-in means 1 consists of a primary conveyor 1.1 and two intermediate conveyors 1.2 and 1.2', all comprising grippers 3 (illustrated by dots). The intermediate conveyors 1.2 and 1.2' take over the articles from the primary conveyor 1.1 in order to transfer them to the conveying-away devices 10 and 10' in two transformation zones 20 and 20', respectively, at two track intersections A and B, respectively, A' and B'.

In both transformation zones 20 and 20', the method evolves, as has been described above in connection with the FIG. 1, wherein, for example, half the articles are taken over by the intermediate conveyor 1.2 and are deposited on the conveying-away means 10 and the other half passes the intermediate conveyor 1.2, is taken over by the intermediate conveyor 1.2' and is deposited on the conveying-away means 10'. The grippers are dammed either by the primary conveyor 1.1 or by the intermediate conveyors 1.2 and 1.2'.

The intermediate conveyors 1.2 and 1.2', which advantageously are designed as small circuits with a limited number of grippers 4 being displaceable independently of one another, can also be missing in which case the primary conveyor 1.1 is directly intersected with the two conveying-away means 10 and 10'. It is, however, clearly evident from FIG. 2, that an embodiment comprising the intermediate conveyors 1.2 and 1.2' renders the arrangement very space-saving, in particular for articles 4 that are conveyed in, while being gripped centrally, which are taken over by the grippers of the intermediate conveyors more laterally and which are, in this state, deflectable around smaller deflection radii. Furthermore, in the embodiment with intermediate conveyors 1.2 and 1.2', the primary conveyor 1.1 can be designed in a simpler manner with grippers 3 connected together to form a chain, i.e. with a constant spacing between them.

Figure 3:
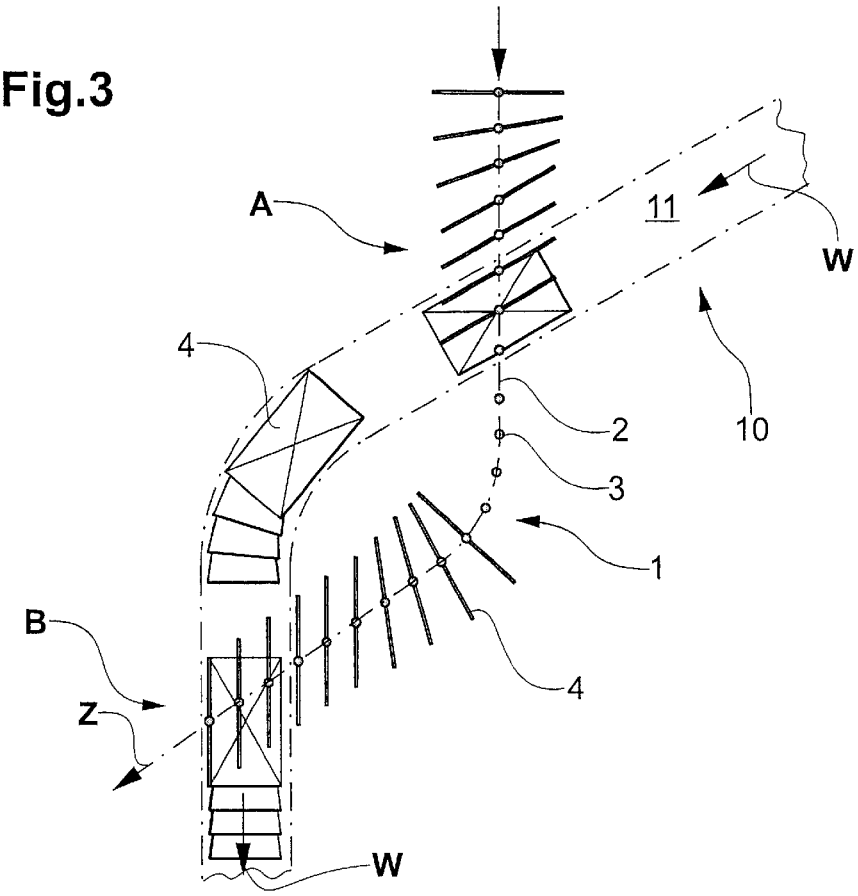
FIG. 3 is a schematic diagram of a stream transformation according to the invention, in which the intersection angle is other than 90°.

FIG. 3, once again from a bird's eye view, illustrates a further, exemplary embodiment of the device in accordance with the invention, comprising a conveying-in means 1 and a conveying-away means 10. The conveying-in track and conveying-away track do not intersect at a right angle, but rather at an oblique angle. For this purpose, the grippers 3 are designed to be able to be rotated relative to the rail 2, so that the articles 4 prior to being deposited on the conveying substrate 11 of the conveying-away means 10 can be aligned parallel to the conveying-away track. This is necessary if the articles 4 comprise edges at right angles to one another and if these edges are to be aligned parallel or transverse respectively to the conveying-away direction W. If this is not the case, the articles can be deposited in their position aligned transverse to the conveying-in direction Z and the intersecting angle is selected according to the desired deposition.

Figure 4:
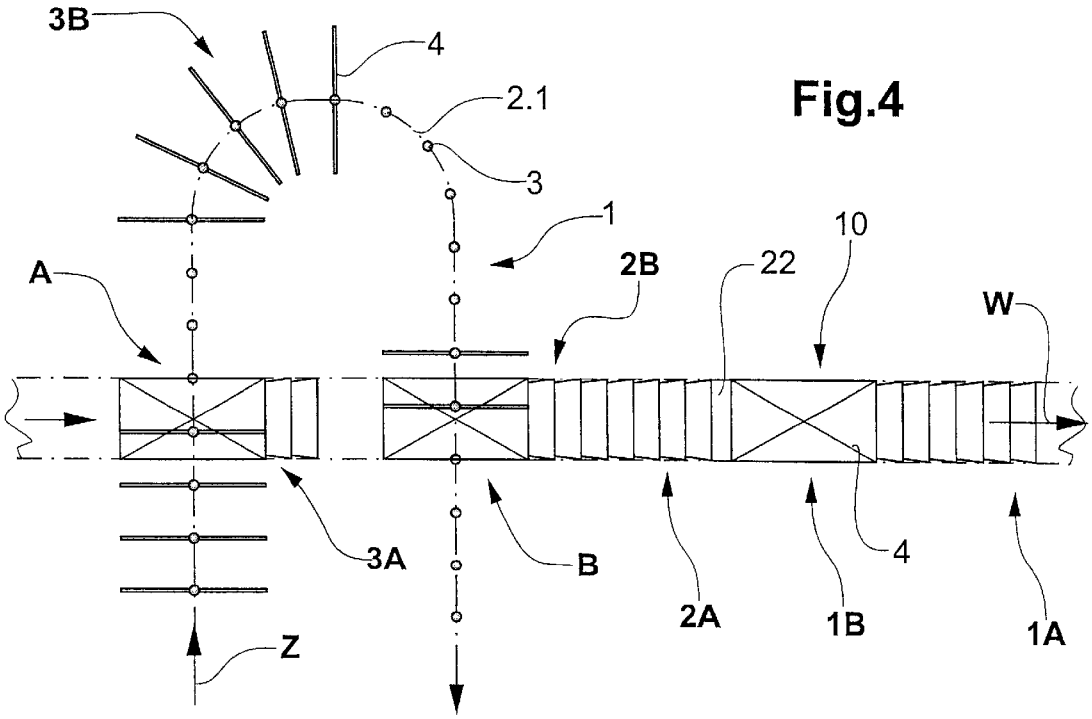
FIGS. 4 to 6 are schematic diagrams of stream transformations according to the invention without gripper buffering upstream of the track intersections
Figure 5:
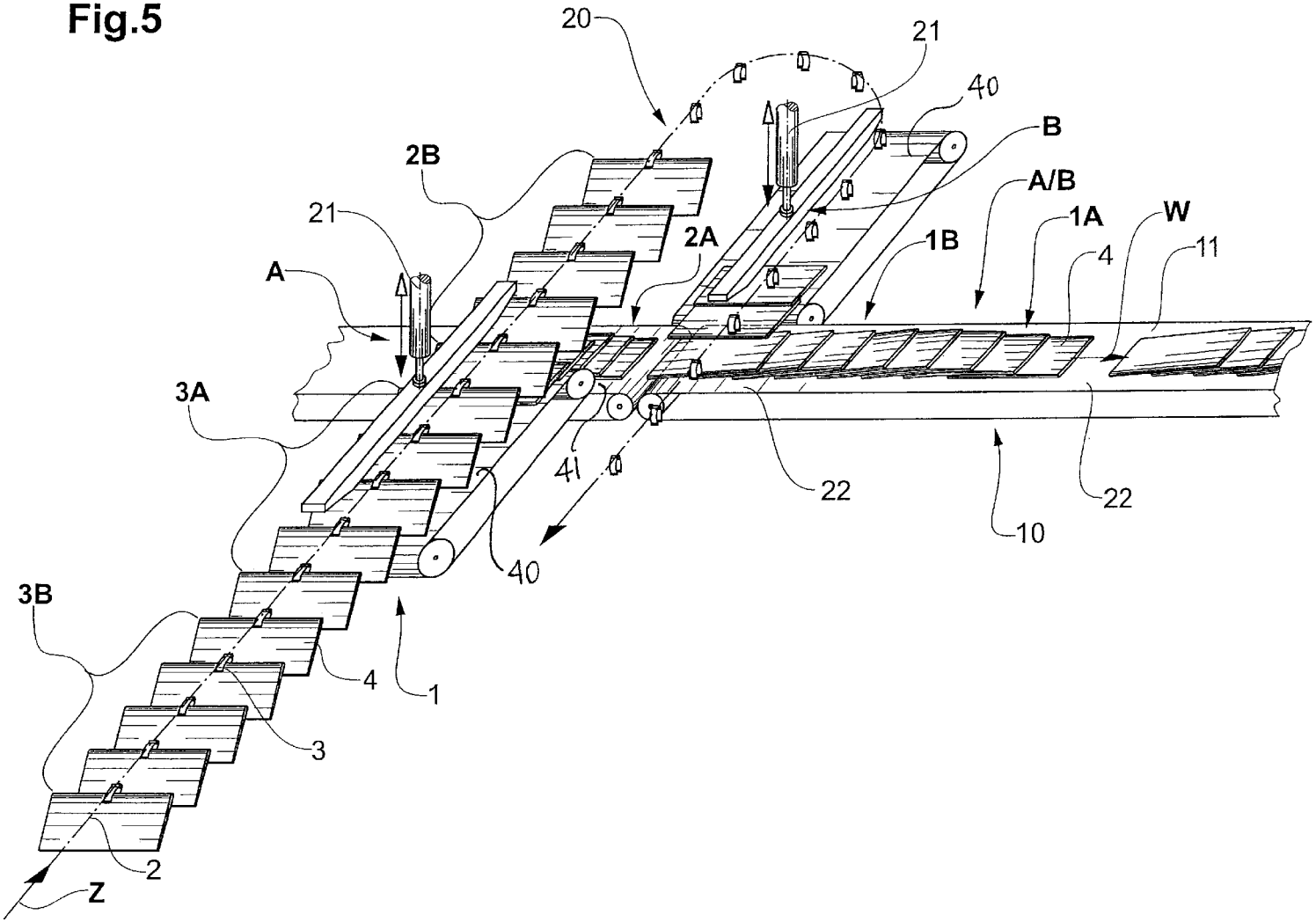
Figure 6:
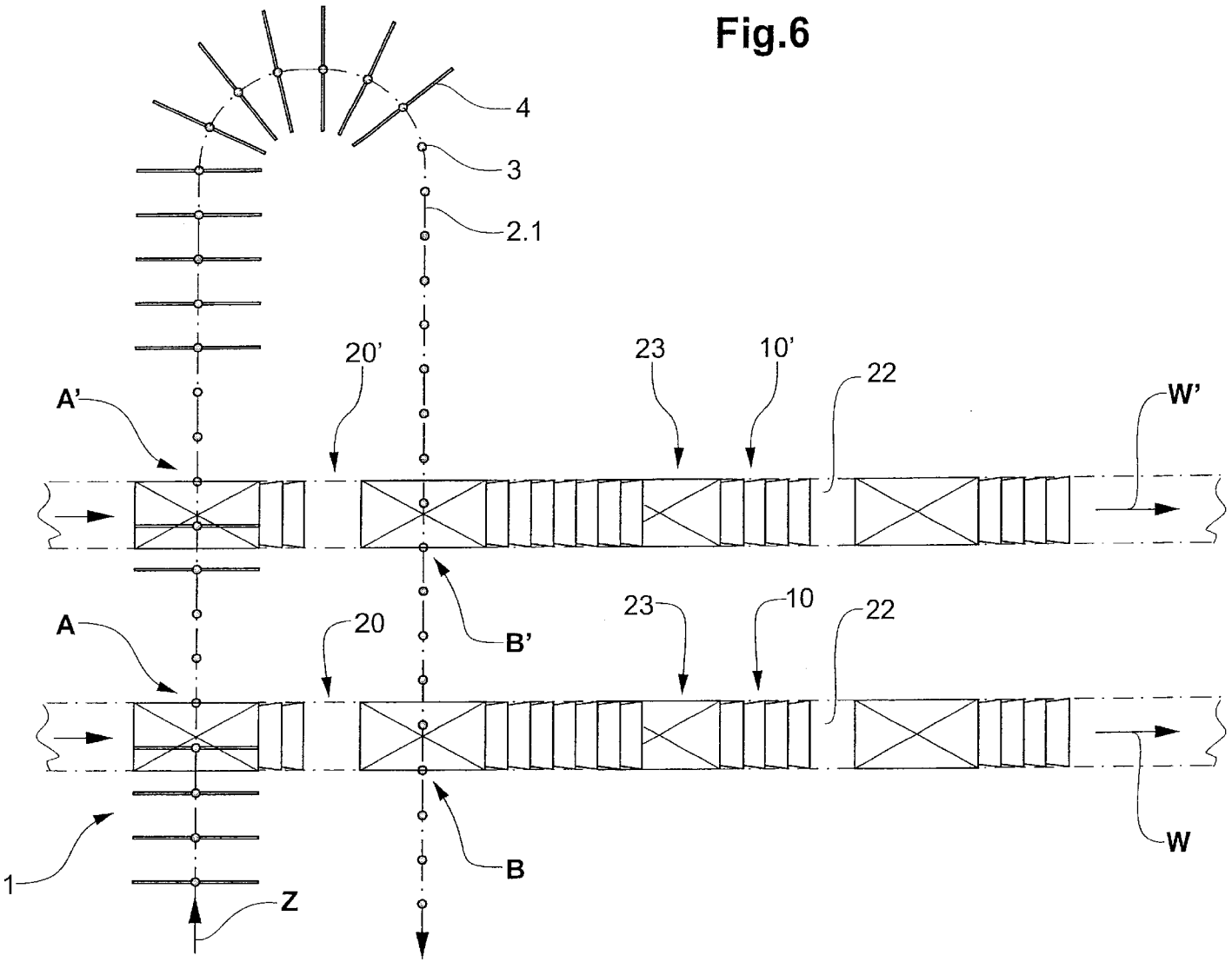

FIGS. 4 to 6 illustrate two further embodiments of the device according to the invention, in which the conveying-in means 1 (without intermediate conveyor) is not equipped with grippers 3 being independent of one another, but rather with grippers 3 that can only be conveyed at regular distances between one another (e.g., a chain 2.1 with grippers 3 equidistantly installed on it). It becomes manifest in these embodiments that the distances of the conveying-in track and of the conveying-away track between the two track intersections A and B have to be matched to the size of the A-groups and the B-groups and to the gaps 22 to be produced between the sections of the imbricated stream.

FIG. 4 depicts an embodiment with a conveying-in means 1 being deflected by 180° between the two track intersections A and B and a substantially straight-lined conveying-away means 10. The A-groups and B-groups to be deposited comprise five articles each. Deposition of the A-groups and of the B-groups takes place simultaneously. At the point in time illustrated, groups 1A, 1B and 2A have already been deposited, of the groups 2B and 3A the third article is just being deposited and group 3B is still on the conveying-in track between the track intersections A and B.

From FIG. 4, it is evident that every pair of an A-group and a following B-group forms a closed and regular imbricated stream section and that the stream gaps 22 between two successive sections are reduced to a minimum. For the case presented here, it is necessary after deposition of the last articles of an A-group and a B-group and after conveyance of the articles of a further B-group past the track intersection A and of the empty grippers of an A-group past the track intersection B, either to stop conveying-in for four cycles or to correspondingly accelerate conveying-away, before further deposition of articles. Only such can it be assured, that the last deposited A-group has reached a location, where a further B-group can be deposited on it.

FIG. 5 illustrates a further, exemplary embodiment of the device in accordance with the invention comprising a conveying-in means 1 with grippers 3 conveyed at equal distances between one another and with a conveying-away means 10 being operated with a constant speed. The gaps 22 in the imbricated stream that are necessary between the deposited groups are, in this case, produced by using an auxiliary conveyor 40 on the conveying-in side and/or an auxiliary conveyor 41 on the conveying-away side. The auxiliary conveyors are operated at speeds differing from the conveying-in speed or the conveying-away speed.

The auxiliary conveyor 40 takes over the articles from the conveying-in means and retards them, which is equivalent to the damming described in connection with FIG. 1. The auxiliary conveyor 41 on the conveying-away side makes it possible to deposit an A-group with a low conveying-away speed and to displace the deposited group with a higher speed.

A further measure for enabling a conveying-in and a conveying-away with constant speeds even when gripper spacings on conveying-in are constant, comprises braking A-groups relative to the conveying-away substrate (reducing spacings between articles) using per se known braking means.

FIG. 6 depicts a device according to the invention, once again comprising a gripper chain (chain 2.1 with grippers 3) or an equivalent conveying means as conveying-in means 1 and further comprising two conveying-away means 10 and 10' defining conveying-away directions W and W'. The conveying away means are intersected by the gripper chain at two track intersections A and B, respectively, A' and B' each. The method evolves in the same manner, as described for FIG. 4. However, the device is designed and controlled such that the conveying-in means 1 and the conveying-away means 10 and 10' can be operated with constant speeds. Deposition at the intersection points A and A' takes place simultaneously. The same applies to deposition in intersection points B and B'. Deposition at A and A' alternates with deposition at B and B'. During conveyance of articles 4 to be deposited at intersections B and B' across intersections A and A' and during conveyance of empty grippers 3 across intersections B and B', the last deposited A-groups are moved across intersections B and B', such that B-groups can be deposited on them. The imbricated streams being produced in the case presented here comprise gaps 22 between imbricated stream sections (comprising an A-group and a B-group each) and enlarged article distances 23 between each A-group and the subsequent B-group.

Figure 7:
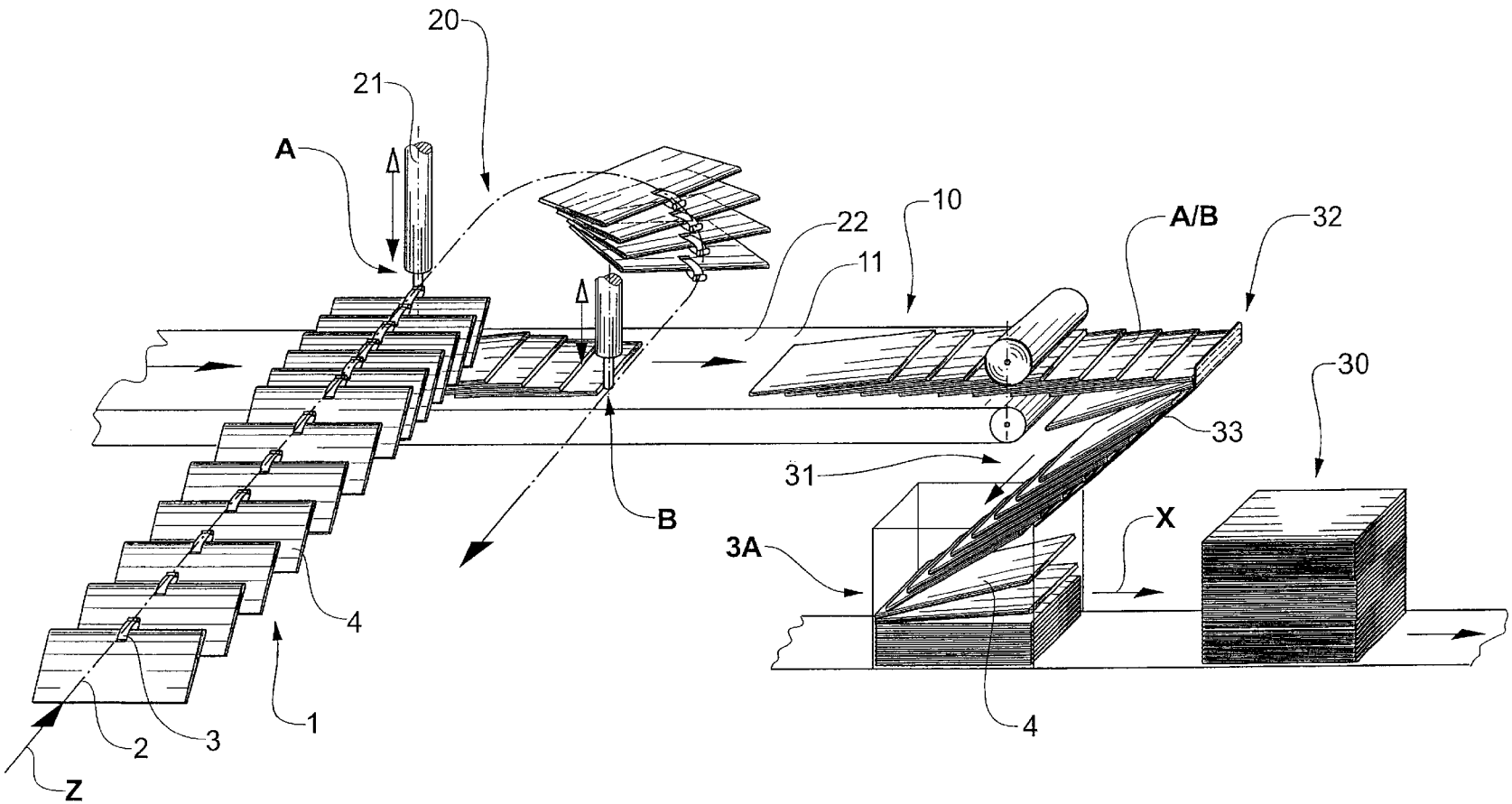

FIG. 7 shows an exemplary and particularly advantageous application and an extension of the method and of the device as shown in FIG. 1. It illustrates production of cross stacks 30 from a conveying-away stream being conveyed away from the stream transformation in accordance with the invention. This conveying-away stream comprises imbricated stream sections 31 each comprising two article groups, in which the articles are rotated by 180° relative to one another, and wherein the imbricated stream sections A/B are separated from one another by gaps 22. The conveying-away stream is brought towards the stacking shaft 34 at an angle from above after a reversal 32 of its direction. For the reversal, the articles are brought onto a further conveying substrate 33, and from there are dropped into the stacking shaft for being stacked. A pushing means (not shown) for pushing finished stack 30 out of the stacking shaft, is movable in a pushing-out direction X opposing the conveying direction of the further conveying substrate 33 and pushes the stack out through the supply side of the shaft. The pushing means is designed such that it is moved back into its starting position outside of the stacking shaft (underneath the stacking shaft or beside the stacking shaft).

In the described arrangement comprising the further conveying substrate 33 and pushing means it is necessary to interrupt the supply of articles to the stacking shaft for pushing out a finished stack. However, supply can be resumed, when the stack 30 is not yet pushed out of the stacking shaft 34 completely, but when its trailing side has passed a point at which the leading edges of the supplied articles 4 would hit the stack to be pushed out. This means, that the supply interruption for pushing the stack out is very short and, for example, the gaps 22 in the supply stream, or at least a part of them, can be exploited for this purpose. This means that neither the stacking operation nor the pushing-out make it necessary for the imbricated stream to be further treated before being supplied to the stacking shaft.

The method illustrated in FIG. 7 is particularly suitable for application with folded printed products (e.g., tabloid newspapers folded once or newspapers folded twice), which in the conveying-in stream are usually held gripped on top by their longer, folded edges. This conveying-in stream is then transformed into a conveying-away stream in which they are conveyed parallel to the folded edges and in which the folded edges of product groups alternately lie on one or the other side of the stream. Because these products are more rigid parallel to their folded edges than perpendicular to them, they can be brought into the stacking shaft 34 with a relatively long free-fall, such that the pushing-out way to be covered before supply resumption for the following stack can be additionally shortened. In addition, the stacks are pushed out parallel to the folded edges, which, because of the higher stacking stability, as compared to the stacking stability transverse to the folded edges, can be implemented with greater speed. Every partial step of the method illustrated in FIG. 7 is therefore carried out in its optimum manner and, despite this, the combination of the partial steps remains conceivably simple.

FIG. 7 therefore illustrates in an impressive manner the simplicity of the method for transforming a conveying stream according to the invention and the simplicity of producing cross stacks using the method in accordance with the invention for transforming a conveying stream. It also shows how space-saving the device for transforming a conveying stream with an integrated stacking device is.

What is claimed is:

1. A method for transforming a conveying stream of flat articles (4) for at least partly changing an orientation of the articles relative to each other in the conveying stream, the method comprising the steps of:

conveying the flat articles (4) held gripped individually in a conveying-in stream along a conveying-in track to a transformation zone (20), conveying the flat articles (4) in a loosely lying manner in a conveying-away stream along a conveying-away track away from the transformation zone (20), wherein in the transformation zone (20) the conveying-in track and the conveying-away track intersect at a first track intersection (A) and at a second track intersection (B) and that the articles (4) are transferred from the conveying-in track to the conveying-away track in groups (1A, 1B, 2A, 2B . . . ) alternately at the first and at the second track intersection (A and B), and, wherein the transfer is controlled in such a manner, that in the conveying-away stream the flat articles (4) are arranged in imbricated stream sections (A/B) comprising one or more successive groups (1A, 1B, 2A, 2B . . . ) and with stream gaps (22) between imbricated stream sections (A/B).

2. The method in accordance with claim 1, wherein, for the transfer from the conveying-in track to the conveying-away track, the flat articles (4) are released from grippers (3) and are deposited on a conveying substrate (11).

3. The method according to claim 1, wherein a conveying-away speed is constant and wherein the articles (4) are conveyed-in with variable distances between one another and are selectively stopped and buffered upstream of the track intersections (A and B).

4. The method according to claim 1, wherein the conveying-away speed is constant, the articles (4) are conveyed-in in a regularly clocked manner, and stream gaps are established by using an auxiliary conveyor (40) on at least one of the conveying-in side and the conveying-away side.

5. The method according to claim 1, wherein the conveying-away speed is increased between transfers of groups (1A, 1B, 2A, 2B . . . ) and wherein the articles (4) are conveyed-in in a regularly clocked manner.

6. The method according to claim 1, wherein two or more conveying-away tracks are provided, each additional conveying-away track comprising a further two track intersections (A', B') with the conveying-in track, and wherein the conveying-away speeds along all conveying-away tracks are constant and the articles (4) are conveyed-in in a regularly clocked manner.

7. The method according to claim 1, wherein the conveying-away track runs in a substantially straight line from the first to the second track intersection (A and B) and the conveying-in track comprises a deflection by 180° between the first and the second track intersection (A and B).

8. The method according to claim 1, wherein the conveying-in track and the conveying-away track intersect at a right angle in both the track intersections (A and B).

9. The method according to claim 1, wherein the conveying-away stream is conveyed to a stacking shaft (34) in which the articles (4) are stacked to form a cross stack (30).

10. The method according to claim 9, wherein the cross stack (30) is pushed out of the stacking shaft (34) in a pushing-out direction (X), and wherein the pushing-out direction (X) is oriented opposite to the direction in which the articles are supplied to the stacking shaft.

11. A device for transforming a conveying stream of flat articles (4) in order to at least partly change an orientation of the articles relative to each other in the stream, the device comprising:

conveying-in means (1) with grippers (3), said conveying in means being movable in a conveying-in direction along a conveying-in track and being adapted for conveying the articles held gripped individually in a conveying-in stream to a transformation zone (20), conveying-away means (10) with a conveying substrate (11), said conveying-away means extending along a conveying-away track and being movable in a conveying-away direction and being adapted for conveying the articles in a conveying-away stream away from the transformation zone, wherein, in the transformation zone, the conveying-in track and the conveying-away track intersect at a first track intersection (A) and at a second track intersection (B), and wherein, at the two track intersections (A and B), control means (21) are provided for selectively opening the grippers (3) for transferring articles from the conveying-in means (1) to the conveying away-means (10) in alternating groups (1A, 1B, 2A, 2B . . . ) at the first and at the second track intersection.

12. The device according to claim 11, wherein the conveying-in means (1) comprises a rail (2) along which the grippers (3) are displaceable independently of one another, and wherein the device further comprises a damming means for stopping and damming the grippers (3) at the two track intersections.

13. The device according to claim 12, wherein the conveying-in means (1) comprises a primary conveyor (1.1) with grippers (3) and an intermediate conveyor (1.2) with grippers (3), and wherein the grippers (3) of at least one of the intermediate conveyor (1.2) or the primary conveyor (1.2) are displaceable independently of one another.

14. The device according to claim 11, wherein the grippers (3) of the conveying-in means (1) are displaceable with a constant spacing between one another.

15. The device according to claim 14, wherein the device further comprises an auxiliary conveyor (40, 41) on at least one of the conveying-in side and the conveying-away side.

16. The device according to claim 14, wherein at least one of the conveying-in means (1) and the conveying-away means (10) is capable of being operated with variable speeds.

17. The device according to claim 11, wherein the conveying-away means (10) runs substantially in a straight line between the track intersections (A and B) and wherein the conveying-in means (1) comprises a deflection by 180° between the track intersections (A and B).

18. The device according to claim 12, wherein a stacking shaft (34) is arranged at an end of the conveying away means (10), said stacking shaft (34) comprising a pushing-out means with a pushing-out direction (X) oriented against a supply side of the stacking shaft (34).

* * * * *